US007211032B2

(12) United States Patent
Shifferaw

(10) Patent No.: US 7,211,032 B2
(45) Date of Patent: May 1, 2007

(54) AIR RESISTANCE EXERCISE DEVICE

(76) Inventor: Tessema Dosho Shifferaw, 1019 Solano Ave., Albany, CA (US) 94706

( * ) Notice: Subject to any disclaimer, the term of this patent is extended or adjusted under 35 U.S.C. 154(b) by 33 days.

(21) Appl. No.: 11/286,153

(22) Filed: Nov. 22, 2005

(65) Prior Publication Data

US 2006/0116258 A1 Jun. 1, 2006

Related U.S. Application Data

(63) Continuation-in-part of application No. 10/996,202, filed on Nov. 22, 2004.

(51) Int. Cl.
*A63B 21/008* (2006.01)
*A63B 23/02* (2006.01)

(52) U.S. Cl. ..... 482/111; 482/3; 482/92

(58) Field of Classification Search ..... 482/7, 482/51, 55, 56, 72, 87–90, 92, 110, 111, 148, 482/3; 446/26–28, 61, 216, 230, 242–243, 446/473; 473/219, 221, 223–224, 228, 457, 473/461, 463, 527; 440/101–103; 280/810; 89/36.05; 416/69, 70 A, 70 R, 71; 441/56; D3/1

See application file for complete search history.

(56) References Cited

U.S. PATENT DOCUMENTS

| | | | | |
|---|---|---|---|---|
| 1,291,464 | A * | 1/1919 | Folliard | 473/527 |
| RE16,671 | E | 7/1927 | Walters | |
| 1,677,888 | A * | 7/1928 | Connors | 416/71 |
| 2,919,919 | A | 1/1960 | Ebb | |
| 3,031,794 | A * | 5/1962 | Zalkind | 43/137 |
| 3,047,302 | A * | 7/1962 | Krylov | 280/810 |
| 3,097,375 | A | 7/1963 | Griffith | |
| 3,411,166 | A * | 11/1968 | Kimmel | 441/65 |
| 3,529,313 | A | 9/1970 | Girden | |
| 4,416,451 | A * | 11/1983 | Solloway | 482/111 |
| 4,603,854 | A * | 8/1986 | Krausz | 482/111 |
| 4,858,916 | A | 8/1989 | Beaumont | |
| 4,890,861 | A * | 1/1990 | Bachmann | 280/810 |
| 4,923,418 | A | 5/1990 | Hoffman | |
| 5,002,275 | A * | 3/1991 | Beutler et al. | 473/228 |
| 5,071,089 | A * | 12/1991 | Fagan | 244/16 |
| 5,100,148 | A * | 3/1992 | Smith | 473/228 |
| 5,190,512 | A * | 3/1993 | Curran | 482/124 |
| 5,304,080 | A | 4/1994 | Dilger | |
| 5,378,217 | A | 1/1995 | D'Orta | |
| 5,531,657 | A * | 7/1996 | Macedo | 482/111 |
| 5,658,224 | A | 8/1997 | Betrock | |
| 6,261,102 | B1 * | 7/2001 | Dugan et al. | 434/252 |
| 6,315,700 | B1 | 11/2001 | Shifferaw | |
| 2006/0116257 | A1 * | 6/2006 | Shifferaw | 482/111 |

FOREIGN PATENT DOCUMENTS

| | | | |
|---|---|---|---|
| DE | 4400191 | A1 * | 7/1995 |
| FR | 2707510 | A1 * | 1/1995 |

* cited by examiner

*Primary Examiner*—Jerome Donnelly
*Assistant Examiner*—Victor K. Hwang
(74) *Attorney, Agent, or Firm*—Edward S. Wright

(57) ABSTRACT

Exercise device and method in which one or more generally planar blades with major surfaces are attached to the ends of an exercise bar. The bar is gripped with the hands and moved in a direction generally perpendicular to the major surfaces, with movement of the bar being resisted by air resistance encountered by the blades.

16 Claims, 5 Drawing Sheets

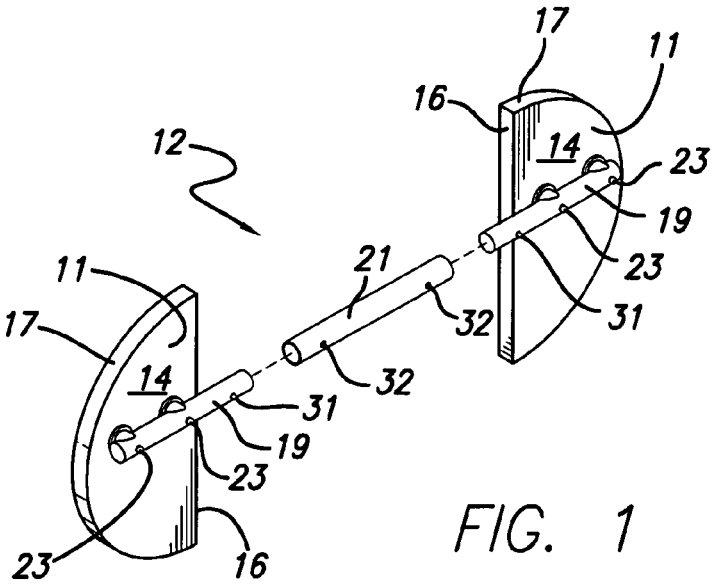
FIG. 1
FIG. 2
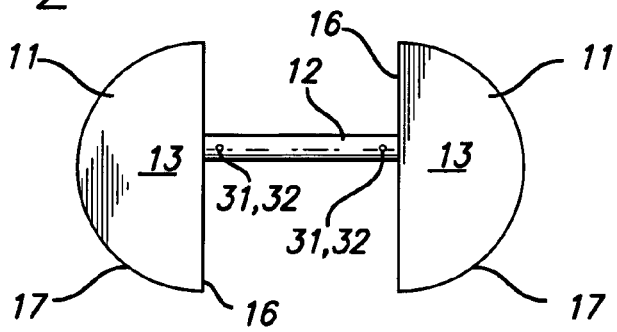
FIG. 3
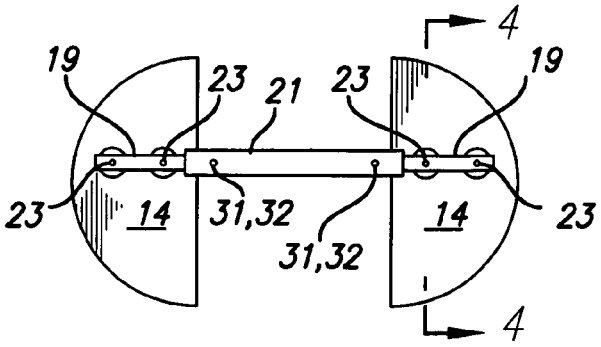
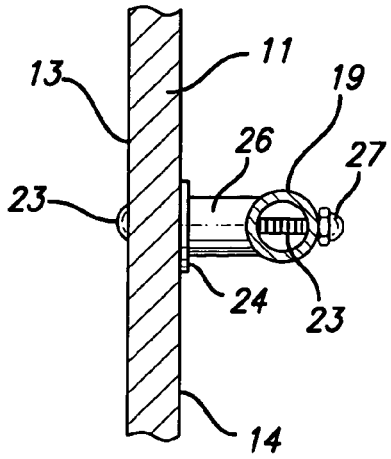
FIG. 4

AIR RESISTANCE EXERCISE DEVICE

CROSS REFERENCE

This is a continuation-in-parts of Ser. No. 10/996,202, filed Nov. 22, 2004.

BACKGROUND

1. Field of Invention

This invention pertains generally to exercise equipment and, more particularly, to apparatus and equipment which is particularly suitable for use in aerobic exercise.

2. Related Art

In recent years, people have become increasingly aware of the benefits of aerobic exercise for increasing energy, burning fat and strengthening the cardiovascular system. Such exercise can also reduce blood pressure and cholesterol levels, as well as stress, thereby reducing the risk of arteriosclerosis and heart disease.

Some forms of aerobic exercise such as walking, running and swimming can be performed without special equipment, although light weights are sometimes used during such exercise to increase the aerobic resistance. Other forms of aerobic exercise such as cycling and other machine assisted exercises require special equipment which can be quite elaborate and expensive.

High impact forms of exercise such as running can be damaging to the knees, hips and other joints of the body, whereas lower impact exercises may not provide the level of exercise desired without special equipment. Such equipment tends to be expensive and limited as to where it can be used, as well as requiring substantial floor space even when not in use.

A novel exerciser comprising a pair of wings worn on the arms of a person to intensify aerobic workouts is shown in U.S. Pat. No. 6,315,700. The wings have large major surfaces, and movement of the arms is resisted by air resistance encountered when the wings are moved in a direction perpendicular to the surfaces.

OBJECTS AND SUMMARY OF THE INVENTION

It is in general an object of the invention to provide a new and improved device and method for doing aerobic exercise.

Another object of the invention is to provide a device and method of the above character which utilize air resistance to increase the intensity of aerobic workouts.

These and other objects are achieved in accordance with the invention by providing an exercise device and method in which one or more generally planar blades with major surfaces are attached to the ends of an exercise bar. The bar is gripped with the hands and moved in a direction generally perpendicular to the major surfaces, with movement of the bar being resisted by air resistance encountered by the blades.

BRIEF DESCRIPTION OF THE DRAWINGS

FIG. 1 is an exploded isometric view of one embodiment of an exercise device according to the invention.

FIG. 2 is a front elevational view of the embodiment of FIG. 1.

FIG. 3 is a rear elevational view of the embodiment of FIG. 1.

FIG. 4 is an enlarged, fragmentary cross sectional view taken along line 4—4 in FIG. 3.

DETAILED DESCRIPTION

Figure 5C:
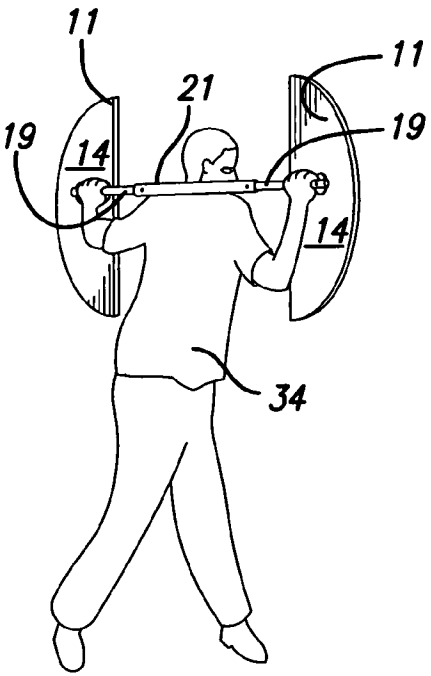
FIGS. 5–7 are isometric views illustrating use of the exercise device in doing different exercises.

As illustrated in FIG. 1, the device has a pair of relatively large, generally planar blades or panels 11, 11 at opposite ends of an exercise bar 12. Each of the blades has major front and rear surfaces 13, 14, with the front surfaces being aligned with each other in a common plane parallel to the exercise bar.

The blades are fabricated of a relatively lightweight, rigid material such as a rigid plastic, a lightweight metal or wood, and in the embodiment of FIG. 1, they have a generally semicircular or D-shaped contour, with straight inner edges 16 and curved outer edges 17. The size of the blades is, in part, dependent upon the amount of air resistance desired, and they typically have a height on the order of 24–36 inches, a width on the order of 18–24 inches, and a thickness on the order of 1–2 inches.

Exercise bar 12 is formed in sections, with end sections 19, 19 and a central section 21. The end sections are affixed to the rear sides of the blades and removably connected to central section 21. The length of the bar is such that the inner edges of the blades are separated by a distance on the order of 24–36 inches and the blades will lie on opposite sides of the exerciser's body when the bar is held in a horizontal position.

The end sections are attached to the blades by bolts 23, with washers 24 and spacers 26 between the end sections and the blades, and nuts 27 on the outer ends of the bolts. The end sections are thus spaced from and parallel to the blades with sufficient distance between them and the blades to receive the fingers of hands gripping the bar. In the embodiment of FIG. 1, the bar is positioned slightly above the horizontal centerline of the blades, which has been found to provide better balance for some exercises. However, it can also be positioned on the centerline or below it, if desired.

The central section of the bar is tubular, and end sections 19 extend into the end portions of the central section. The end sections are secured to the central section by detents consisting of spring-loaded pins 31 on the end sections and openings 32 in the side wall of the central section. The end sections are attached to the central section by depressing the detent pins, sliding the end sections into the outer ends of the central section, and aligning the pins with the openings. They are removed by depressing the pins and withdrawing the end sections.

The bar is fabricated of a lightweight, relatively rigid material such as aluminum or plastic. In one embodiment, the central section is a length of aluminum tubing, and the outer sections are lengths of PVC tubing.

Figure 5B:
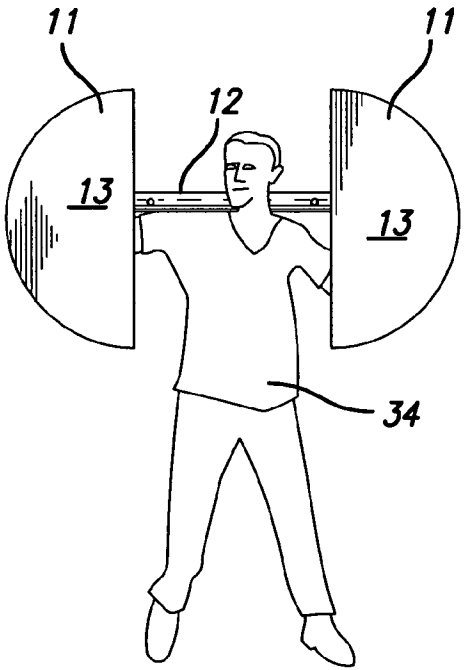
Figure 5A:
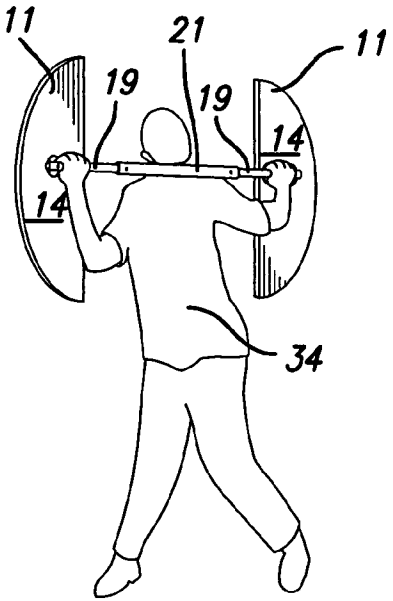

Use of the device in doing a twisting abdominal exercise is illustrated in FIGS. 5A–5C. With the bar resting on his shoulders and his hands gripping the end sections of the bar, an exerciser 34 alternately rotates or twists his body to the right and to the left. As he does, the blades are moved in a direction perpendicular to their major surfaces, and the resulting air resistance creates additional work for the abdomen and torso, with the amount of the resistance being dependent upon the size of the blades and the speed at which they are moved.

In addition to providing resistance for the exerciser to work against, the air resistance also prevents over extension of the back and provides cushioning to the movement of the exerciser.

Figure 6A:
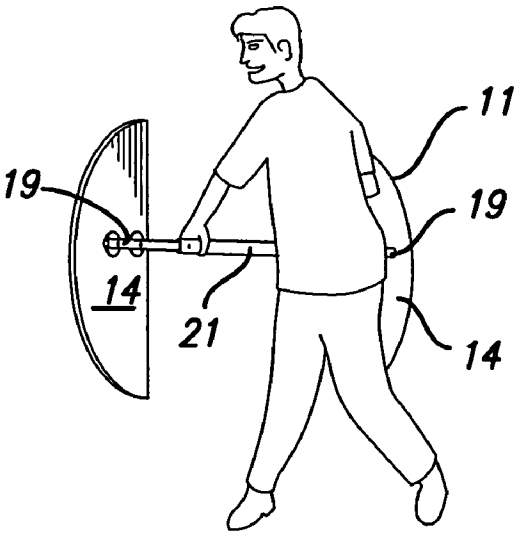
Figure 6B:
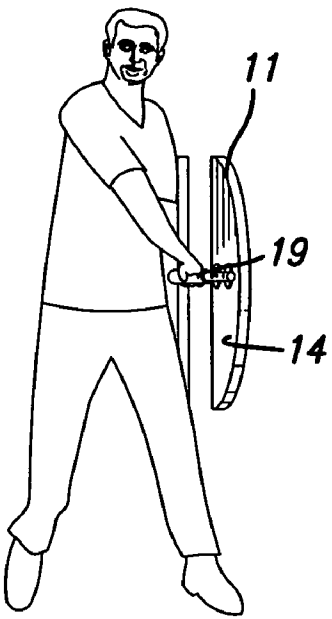
Figure 6C:
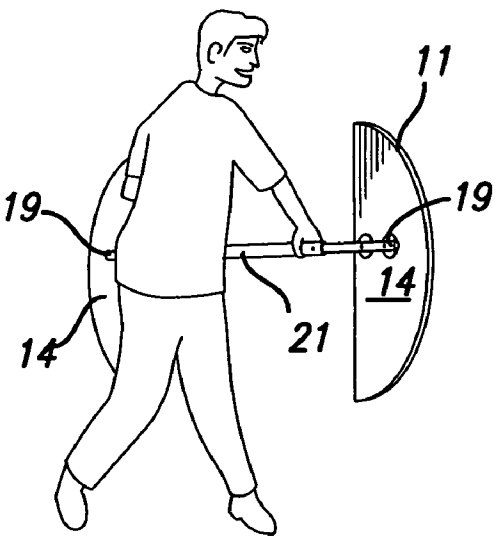

In the exercise illustrated in FIGS. 6A–6C, the exerciser grips the central section of the bar, with his hands over the bar and his arms extended in a downward direction near his sides. He once again rotates his body alternately to the right and to the left, swinging the bar in a direction generally perpendicular to the major surfaces of the blades as he does so. The resistance of the air to the movement of the blades works the torso, trapezium, abdomen and arms, much like rowing exercises and kayaking.

Figure 7C:
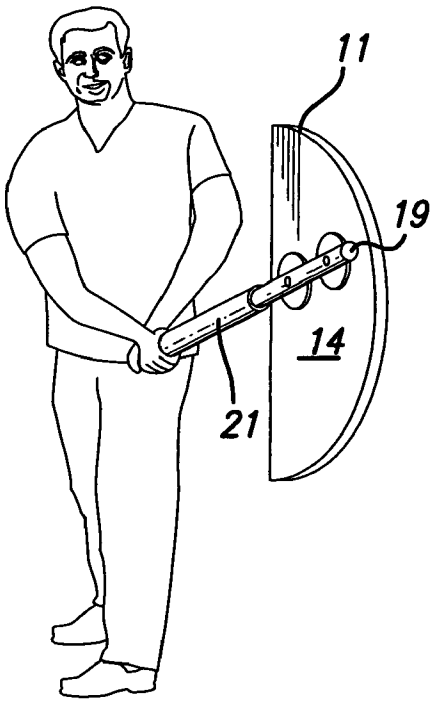
Figure 7B:
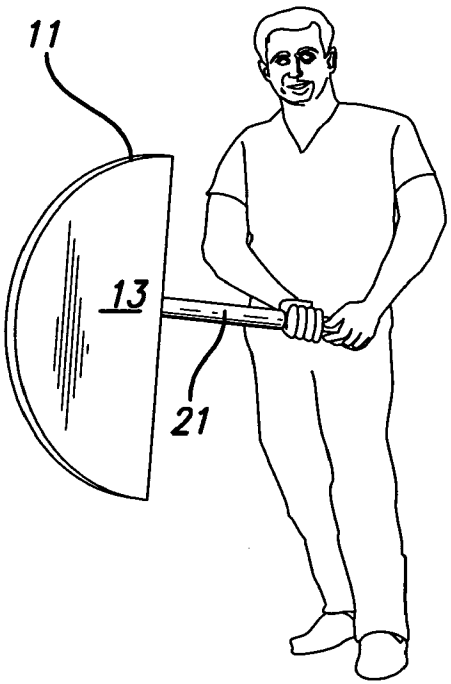
Figure 7A:
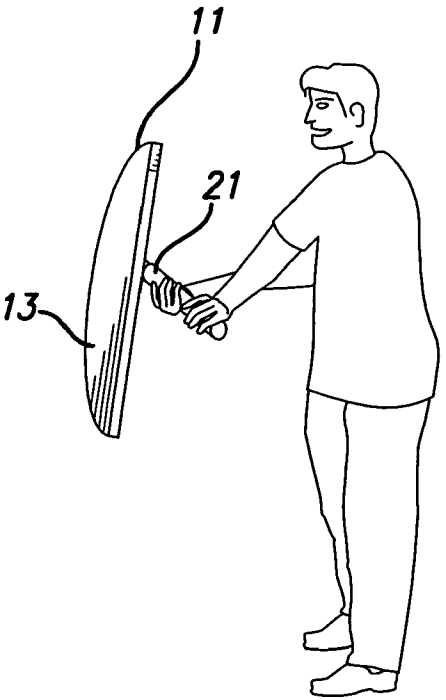

The device can also be used as a trainer for a particular sport, and FIGS. 7A–7C show it being used as a baseball trainer. For that purpose, the blade is removed from one end of the bar, and the exerciser grips that end in a manner similar to the way he would grip a baseball bat. He then swings the device back and forth in front of him, exercising the same muscles that are used in swinging a bat. By gripping the bar and swinging the device in the manner of a golf club, tennis racket or the like, the device can be used to exercise the muscles used those and other sports. The cushioning provided by the air resistance makes the device particularly suitable for use in rehabilitating the muscles that are used for the particular sport.

Figure 8:
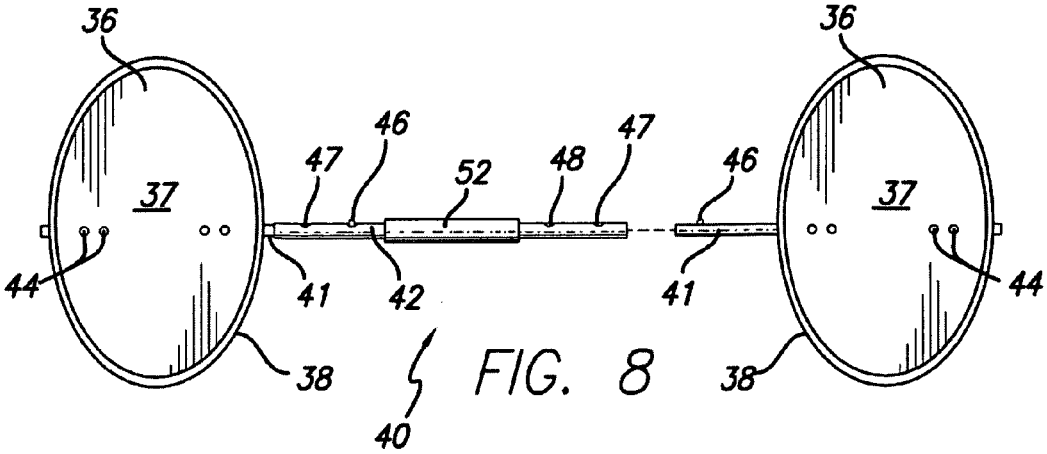
FIG. 8 is front elevational view, partly exploded, of another embodiment of an exercise device according to the invention.
Figure 9:
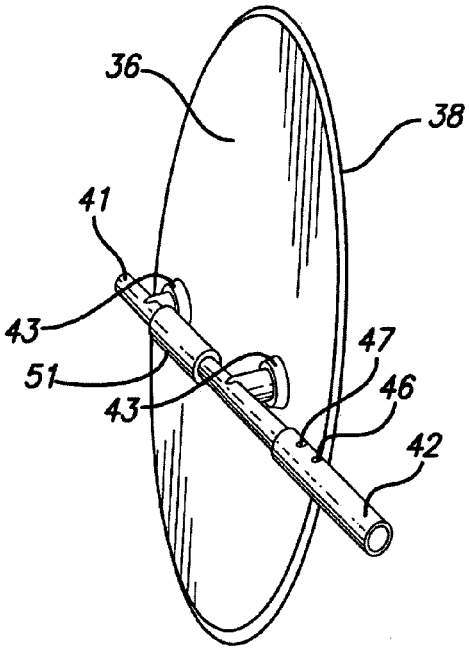
FIG. 9 is an enlarged, fragmentary, rear isometric view of the embodiment of FIG. 8.

In the embodiment of FIG. 8, blades or wings 36, 36 are oval shaped, and in one embodiment have major and minor axes with lengths on the order of 27 and 18.5 inches, respectively. These blades comprise panels 37 of a lightweight, rigid material, which in the embodiment illustrated is a corrugated PVC, with a band 38 of soft plastic material along the edge of each of the panels. With this structure and the dimensions given, each of the wings weighs less than a pound.

Exercise bar 40 is similar to exercise bar 12 in that it has end sections 41, 41 which extend from a tubular central section 42. The wings are offset laterally from the bar by spacers 43 and affixed to the end sections by screws 44. In this embodiment, however, the bar is aligned with the horizontal centerlines or minor axes of the wings.

As in the embodiment of FIG. 1, end sections 41 extend into the end portions of central section 42 and are releasably affixed to the central section by detents consisting of spring-loaded pins 46 on the end sections and openings in the side wall of the central section. In this embodiment, however, there are two axially spaced detent openings 47, 48 toward each end of the central section, which permits the length of the bar to be adjusted to change the spacing between the wings.

Bar 40 is also fabricated of a lightweight, relatively rigid material such as aluminum or plastic, and in one embodiment, both the central section and the outer sections are lengths of PVC tubing.

Handgrips 51, 52 are mounted on the end sections of the bar behind the wings and on the central section between them.

Figure 10:
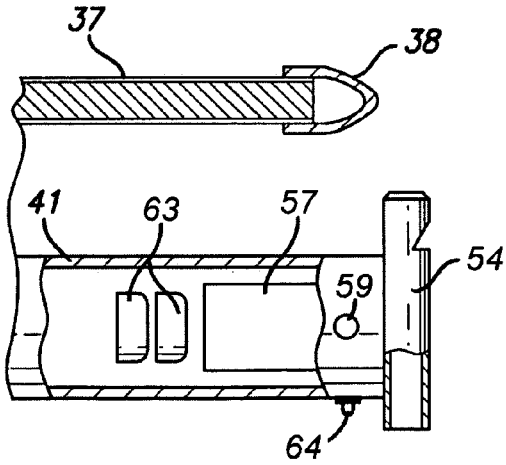
FIG. 10 is an enlarged, fragmentary, cross-sectional view of the embodiment of FIG. 8.
Figure 11:
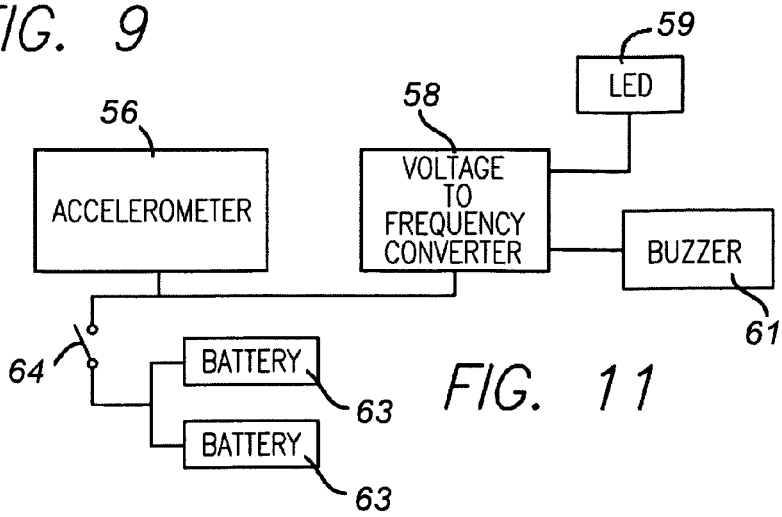
FIG. 11 is a block diagram of the sensor and processing circuitry in the embodiment of FIG. 8.

As best seen in FIGS. 10 and 11, it means is included in the embodiment of FIG. 8 for monitoring the rate at which the wings are swung through the air and the amount of energy or calories which are being expended. This means includes a sensor 54 which is mounted at each end of exercise bar, just beyond the outer edges of the wings. In the embodiment illustrated, the sensors are whistles which produce a tone that varies in pitch in accordance with the rate at which the wings move through the air in a direction perpendicular to the major surfaces of the wings, with electronic rate sensors 56 in the form of accelerometers within the bodies of the whistles. If desired, just whistles or accelerometers can be included, if desired.

Signals from each of the accelerometers are processed by electronic circuitry 57 which, in the embodiment illustrated, comprises a voltage to frequency converter 58 which provides an output signal which varies in frequency in accordance with the rate signals and, hence, the rate at which the wings or blades are traveling. The output signals from the voltage to frequency converter are applied to a light emitting diode (LED) 59 and to a buzzer 61. The LED employed in the preferred embodiment is a frequency responsive device which changes color in accordance with the rate of movement, and the buzzer produces a tone which varies in pitch in accordance with the frequency of the signal applied to it. If desired, either the LED or the buzzer can be omitted in a given application.

Operating power is applied to the electronic components from batteries 63 and controlled by an ON/OFF switch 64. As shown in FIG. 10, the ON/OFF switch and the LED's are mounted on the bar near the ends, and the batteries end the processing circuitry are mounted in the bar near the switches and the LED's.

Operation and use of the embodiment of FIG. 8 is similar to that of the embodiment of FIG. 1, and any of the exercises illustrated in FIGS. 5A through 7C can also be done with the embodiment of FIG. 8. In the embodiment of FIG. 8, the exerciser is provided with an audible and/or visual indication of the rate at which he is swinging the blades and the amount of energy or calories he is expending. The energy or calory consumption is determined by reference to a look-up table, and by keeping the LED at a constant brightness or intensity for a given period of time, the exerciser will know how many calories he has burned. Similar sensors can also be employed in the embodiment of FIG. 1, if desired.

The invention has a number of important features and advantages. It provides a simple, lightweight device and method for intensifying the effect of aerobic exercise. The exerciser can control the amount of resistance by swinging the device faster or slower, depending upon the degree of exercise desired. In addition to providing resistance for the exerciser to work against, the air resistance also prevents over extension and provides cushioning to the movement of the exerciser. The device can be used to exercise and/or rehabilitate the muscles that are used in a variety of exercises and sports.

The invention is a significant improvement over other types of exercise and fitness equipment in that each of the two blades or wings provides positive, dynamic air resistance, with no negative resistance. Working out with the device has been found to help tone muscles as well as providing aerobic exercise as it is swung faster. With the lightweight structure, the device has no appreciable momentum or inertia, it can utilize fast, rhythmic movements without injuring the joints or causing tendinitis.

It is apparent from the foregoing that a new and improved exercise device and method have been provided. While only certain presently preferred embodiments have been described in detail, as will be apparent to those familiar with the art, certain changes and modifications can be made without departing from the scope of the invention as defined by the following claims.

The invention claimed is:

1. An exercise device comprising a rigid bar fabricated of a lightweight material, a pair of lightweight oval shaped panels mounted on the bar toward opposite ends of the bar and offset laterally from the bar, with front and rear major surfaces of the panels parallel to the bar and each of the panels having a major axis extending in a direction perpendicular to the bar and a minor axis extending in a direction parallel to the bar, end handgrips on the bar behind the panels.

2. The exercise device of claim 1 wherein the panels are fabricated of a rigid corrugated material.

3. The exercise device of claim 1 wherein the major axes of the panels have a length on the order of 27 inches, the minor axes have a length on the order of 18.5 inches, and each of the panels weighs no more than one pound.

4. The exercise device of claim 1 including an additional handgrip on the bar between the panels.

5. The exercise device of claim 1 wherein the panels are aligned in a common plane.

6. The exercise device of claim 1 wherein the bar has a pair of end sections which are affixed to the panels and a central section to which the end sections are connected.

7. The exercise device of claim 6 wherein the end sections are connected to the central section in a manner permitting the length of the bar to be adjusted.

8. The exercise device of claim 1 including means carried by the device for indicating the rate at which the panels travel in a direction perpendicular to the major surfaces.

9. The exercise device of claim 8 wherein the means for indicating the rate at which the panels travel includes a whistle which produces a tone at a pitch corresponding to the rate of travel.

10. The exercise device of claim 8 wherein the means for indicating the rate at which the panels travel comprises an electronic rate sensor, circuitry for processing signals from the rate sensor, and means responsive to the processed signals for providing an audible indication of the rate of travel.

11. The exercise device of claim 8 wherein the means for indicating the rate at which the panels travel comprises an electronic rate sensor, circuitry for processing signals from the rate sensor, and means responsive to the processed signals for providing a visual indication of the rate of travel.

12. The exercise device of claim 11 wherein the means for providing a visual indication of the rate of travel comprises a light emitter which produces light which varies in color in accordance with the rate of travel.

13. An exercise device comprising a rigid bar, a pair of generally planar blades which are attached to opposite ends of the bar and offset laterally from the bar, have major surfaces parallel to the bar, and are resistant to movement through air in a direction perpendicular to the major surfaces, an electronic rate sensor carried by the device for producing a signal corresponding to the rate at which the panels travel in a direction perpendicular to the major surfaces, circuitry carried by the device for processing signals from the rate sensor, and means carried by the device and responsive to the processed signals for providing an indication of the rate of travel.

14. The exercise device of claim 13 wherein the means for providing an indication of the rate of travel comprises means for producing an audible tone which varies in pitch in accordance with the rate of travel.

15. The exercise device of claim 13 wherein the means for providing an indication of the rate of travel comprises a light source which produces a visible light that changes color in accordance with the rate of travel.

16. The exercise device of claim 13 wherein the rate sensor comprises an accelerometer which provides a voltage corresponding to the rate of travel, and the circuitry includes a voltage to frequency converter which provides a signal which varies in frequency in accordance with the rate at which the panels travel.

* * * * *